US009446923B2

(12) United States Patent
Yoshida et al.

(10) Patent No.: US 9,446,923 B2
(45) Date of Patent: Sep. 20, 2016

(54) SHEET CONVEYING APPARATUS AND IMAGE FORMING APPARATUS

(71) Applicant: CANON KABUSHIKI KAISHA, Tokyo (JP)

(72) Inventors: Masatoshi Yoshida, Susono (JP); Hiroharu Tsuji, Numazu (JP); Tomooku Koyama, Suntou-gun (JP); Takuya Keino, Mishima (JP); Junichi Ochi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/349,816

(22) PCT Filed: Dec. 4, 2012

(86) PCT No.: PCT/JP2012/007765

§ 371 (c)(1),
(2) Date: Apr. 4, 2014

(87) PCT Pub. No.: WO2013/084474

PCT Pub. Date: Jun. 13, 2013

(65) Prior Publication Data

US 2014/0239580 A1 Aug. 28, 2014

(30) Foreign Application Priority Data

Dec. 9, 2011 (JP) ..... 2011-270098

(51) Int. Cl.
*B65H 5/02* (2006.01)
*B65H 7/06* (2006.01)
(Continued)

(52) U.S. Cl.
CPC ..... *B65H 7/06* (2013.01); *B65H 5/068* (2013.01); *B65H 9/004* (2013.01); *B65H 29/125* (2013.01);
(Continued)

(58) Field of Classification Search
CPC ..... B65H 2404/14; B65H 2301/42124; B65H 5/062; B65H 5/02; B65H 5/06; B65H 2404/144; B65H 2404/1451; B65H 29/06; B65H 29/12; B65H 29/125; B65H 29/14; B65H 29/145; B65H 29/20; B65H 29/22; B65H 29/243; B65G 47/31; B65G 47/261
USPC ..... 271/272–274, 314, 216, 3.01; 198/419.2, 624, 608; 414/796.5, 797.3; 270/52.18, 58.01
See application file for complete search history.

(56) References Cited

U.S. PATENT DOCUMENTS 5,383,656 A 1/1995 Mandel et al.
5,951,004 A 9/1999 Hadfy-Kovacs et al.
(Continued)

FOREIGN PATENT DOCUMENTS

EP 0613846 A1 9/1994
EP 0816271 A1 1/1998
(Continued)

OTHER PUBLICATIONS

International Search Report issued in International Application No. PCT/JP2012/007765, dated Mar. 27, 2013.

*Primary Examiner* — Thomas Morrison
(74) *Attorney, Agent, or Firm* — Fitzpatrick, Cella, Harper & Scinto

(57) ABSTRACT

Provided is a sheet conveying apparatus including: a pair of rollers which includes an upper roller and a lower roller and conveys a sheet in a nipping manner; a driving unit which independently drives the upper roller and the lower roller; a conveying unit which is disposed at the upstream of the pair of rollers in the sheet conveying direction and conveys the sheet to the pair of rollers; an overlapping unit which is provided between the pair of rollers and the conveying unit and overlaps a subsequent sheet on a precedent sheet in the conveying direction; and a control unit which controls the driving unit, wherein the control unit controls the driving unit so that: the upper roller and the lower roller are driven before a leading end of the precedent sheet conveyed by the conveying unit reaches the pair of rollers and the driving of the upper roller and the lower roller is stopped before a tail end of the precedent sheet passes the pair of rollers; the pair of rollers is driven again before a leading end of the subsequent sheet conveyed by the conveying unit and overlapped on the precedent sheet nipped by the pair of rollers reaches the pair of rollers and only the upper roller is driven so as to convey the subsequent sheet to the downstream in the conveying direction after the leading end of the subsequent sheet conveyed by the conveying unit reaches the pair of rollers; and the upper roller and the lower roller are driven so as to convey the precedent sheet and the subsequent sheet overlapped on the precedent sheet to the downstream in the conveying direction.

5 Claims, 10 Drawing Sheets

(51) Int. Cl.

| | |
|---|---|
| ***B65H 29/12*** | (2006.01) |
| ***G03G 15/00*** | (2006.01) |
| ***B65H 5/06*** | (2006.01) |
| ***B65H 9/00*** | (2006.01) |
| *B42B 4/00* | (2006.01) |

(52) U.S. Cl.

CPC ..... *G03G 15/6529* (2013.01); *G03G 15/6573* (2013.01); *B42B 4/00* (2013.01); *B65H 2301/4213* (2013.01); *B65H 2404/14* (2013.01); *B65H 2404/16* (2013.01); *B65H 2511/20* (2013.01); *B65H 2511/22* (2013.01); *B65H 2513/40* (2013.01)

(56) References Cited

U.S. PATENT DOCUMENTS

| | | | | |
|---|---|---|---|---|
| 7,306,214 | B2 | 12/2007 | Iida et al. | |
| 7,431,280 | B2 * | 10/2008 | Stauber et al. | 271/9.13 |
| 7,744,085 | B2 * | 6/2010 | Tsutsui et al. | 271/221 |
| 7,753,368 | B2 | 7/2010 | Sekiyama et al. | |
| 7,959,146 | B2 * | 6/2011 | Gerlier et al. | 271/3.03 |
| 8,061,712 | B2 | 11/2011 | Tsuji et al. | |
| 8,382,109 | B2 | 2/2013 | Tsuji et al. | |
| 8,444,141 | B2 | 5/2013 | Sekiyama et al. | |
| 8,668,198 | B2 | 3/2014 | Tsuji et al. | |
| 2005/0067777 | A1 | 3/2005 | Iida et al. | |
| 2006/0071411 | A1 | 4/2006 | Obuchi et al. | |
| 2008/0073837 | A1 * | 3/2008 | DeGruchy | 271/273 |
| 2013/0100219 | A1 | 4/2013 | Tokisawa et al. | |

FOREIGN PATENT DOCUMENTS

| | | | |
|---|---|---|---|
| EP | 0970902 | A2 | 1/2000 |
| EP | 0613846 | B1 | 6/2000 |
| EP | 0816271 | B1 | 1/2002 |
| JP | 56-149942 | * | 11/1981 |
| JP | 10152253 | A | 6/1998 |
| JP | 3368351 | B2 | 1/2003 |

* cited by examiner

SHEET CONVEYING APPARATUS AND IMAGE FORMING APPARATUS

BACKGROUND OF THE INVENTION

1. Field of the Invention

The present invention relates to a sheet conveying apparatus conveying two sheets in an overlapped state and an image forming apparatus having the same.

2. Description of the Related Art

In an existing sheet post-processing device with a post-processing unit such as a stapler, a subsequent sheet may not be received during the execution of sheet post-processing of a precedent sheet since it takes time for the sheet post-processing such as aligning and stapling. In order to solve this problem, there is known a configuration in which the sheet post-processing time of the precedent sheet is ensured by conveying sheets while a predetermined number of subsequent sheets conveyed during the sheet post-processing of the precedent sheet are overlapped on each other.

As an apparatus that conveys sheets in an overlapped state, there is known a conveying apparatus disclosed in, for example, Japanese Patent Laid-Open No. 10-152253. The sheet conveying apparatus includes two pairs of rollers having different circumferential velocities. Here, when a sheet is nipped between a large-diameter roller having a slow circumferential velocity and a pinching roller, the leading end of the subsequent sheet sent from the roller having a fast circumferential velocity enters between the precedent sheet and the large-diameter roller.

More specifically, the apparatus has the following configuration. A sheet which is conveyed fast by a conveying roller decreases in speed to an intermediate speed in a speed decreasing region existing at the downstream region in relation to a position facing the conveying roller. When the sheet is further conveyed in an intermediate conveying portion, the leading end of the sheet contacts the large-diameter roller having a slow circumferential velocity so that the leading end is drawn thereto. The subsequent sheet also decreases in speed in this way and catches up the precedent sheet. At this time, the precedent sheet is nipped between the large-diameter roller and the pinching roller and largely turns along the peripheral surface of the large-diameter roller, so that the tail end separates from the roller and jumps along the outer shape of the large-diameter roller. For this reason, the leading end of the subsequent sheet enters between the tail end of the precedent sheet and the large-diameter roller, so that the sheets may be conveyed in a overlapped state.

However, in the invention disclosed in Japanese Patent Laid-Open No. 10-152253, the shift amount of two sheets may not be stabilized when the gap between the sheets changes due to a variation in the sheet feeding timing because of the configuration in which the sheets are overlapped on each other while being shifted in the conveying direction using the speed reduction mechanism. When there is a reference wall which is provided at the downstream and serves as a reference for aligning the sheets in the conveying direction upon conveying two overlapped sheets, two sheets are overlapped on each other in a shifted state so that the precedent sheet advances in the conveying direction in relation to the subsequent sheet and hence the downstream end in the conveying direction of the precedent sheet as the lower sheet of the two sheets first abuts the reference wall. After the downstream end in the conveying direction of the precedent sheet shifted in this way abuts the reference wall, the subsequent sheet as the upper sheet slides on the precedent sheet and abuts the reference wall, so that two sheets are completely aligned in the conveying direction. At this time, if the shift amount of two sheets increases, even when the lower precedent sheet first abuts the reference wall, the upper subsequent sheet stops without reaching the reference wall, and hence there is a problem in that an aligning failure of the sheet occurs.

FIG. 10 is a schematic cross-sectional view of a conveying direction aligning portion of the sheet post-processing device. Referring to FIG. 10, a mechanism will be specifically described in which an aligning failure occurs in the sheet post-processing device at the downstream of a sheet overlapping device when there is a variation in the shift amount of two sheets. The sheet overlapping device is disposed at the upstream of the sheet post-processing device, and the subsequent sheet S2 is conveyed from the image forming apparatus body to the sheet post-processing device so that post-processing such as stapling is performed while the subsequent sheet S2 advances with a shift amount in the conveying direction L in relation to the precedent sheet S1.

Subsequently, when a leading end of a conveying direction aligning portion 306 existing at the downstream of an aligning reference wall 317 moves downward from the upper side so as to abut the sheets on an intermediate stacking portion 303, two sheets which are conveyed to the intermediate stacking portion 303 collide with the aligning reference wall 317 so that the sheets are aligned.

Here, as illustrated in FIG. 10A, a case is assumed in which the distance between the tail end of the precedent sheet S1 and the aligning reference wall 317 is denoted by A and the distance between the tail end of the subsequent sheet S2 and the rotation center of the conveying direction aligning portion 306 is denoted by B during or before the aligning operation. In this case, it is desirable to satisfy the relation of A=B with high precision as much as possible so as to suppress the aligning failure.

If a variation in the shift amount of two sheets satisfies the relation of A>B before the aligning operation, the tail end of the subsequent sheet S2 is involved into the nip of the conveying direction aligning portion 306 before the tail end of the precedent sheet S1 reaches the aligning reference wall 317 as illustrated in FIG. 10B during the aligning operation. For this reason, two sheets S1 and S2 are simultaneously nipped in the conveying direction aligning portion 306. In this case, since the conveying direction aligning portion 306 abuts the subsequent sheet S2 from the upper side in a condition in which the friction coefficient between the intermediate stacking portion 303 and the sheet S1 is higher than the friction coefficient between the sheets S1 and S2, only the subsequent sheet S2 is aligned. Accordingly, the tail end of the precedent sheet S1 may not reach the aligning reference wall 317 even when the aligning operation ends, and the sheet bundle takes a posture in which the precedent sheet S1 advances in relation to the subsequent sheet S2 in the conveying direction L, thereby causing the aligning failure of the precedent sheet S1.

Further, if a variation in the shift amount of two sheets satisfies the relation of A<B before the aligning operation, the tail end of the subsequent sheet S2 may not reach the conveying direction aligning portion 306 when the tail end of the precedent sheet S1 reaches the aligning reference wall 317 as illustrated in FIG. 10C during the aligning operation. Accordingly, the tail end of the subsequent sheet S2 may not reach the aligning reference wall 317 even when the aligning operation ends, and the subsequent sheet S2 advances in relation to the precedent sheet S1 in the conveying direction L, thereby causing the aligning failure of the subsequent sheet S2.

The invention is made in view of the above-described circumstances, and it is desirable to provide a sheet conveying apparatus capable of controlling a shift amount of sheets with high precision even when there is a variation in the shift amount between a precedent sheet and a subsequent sheet which are being conveyed.

SUMMARY OF THE INVENTION

Provided is a sheet conveying apparatus including: a pair of rollers which includes an upper roller and a lower roller and conveys a sheet in a nipping manner; a driving unit which independently drives the upper roller and the lower roller; a conveying unit which is disposed at the upstream of the pair of rollers in the sheet conveying direction and conveys the sheet to the pair of rollers; a overlapping unit which is provided between the pair of rollers and the conveying unit and overlaps a subsequent sheet on a precedent sheet in the conveying direction; and a control unit which controls the driving unit, wherein the control unit controls the driving unit so that: the upper roller and the lower roller are driven before a leading end of the precedent sheet conveyed by the conveying unit reaches the pair of rollers and the driving of the upper roller and the lower roller is stopped before a tail end of the precedent sheet passes the pair of rollers; the pair of rollers is driven again before a leading end of the subsequent sheet conveyed by the conveying unit and overlapped on the precedent sheet nipped by the pair of rollers reaches the pair of rollers and only the upper roller is driven so as to convey the subsequent sheet to the downstream in the conveying direction after the leading end of the subsequent sheet conveyed by the conveying unit reaches the pair of rollers; and the upper roller and the lower roller are driven so as to convey the precedent sheet and the subsequent sheet overlapped on the precedent sheet to the downstream in the conveying direction.

According to the invention, even when there are diverse shift amounts between the precedent sheet and the subsequent sheet which are being conveyed, it is possible to control the shift amount of the sheet with high precision.

Further features of the present invention will become apparent from the following description of exemplary embodiments with reference to the attached drawings.

DESCRIPTION OF THE EMBODIMENTS

Figure 1:
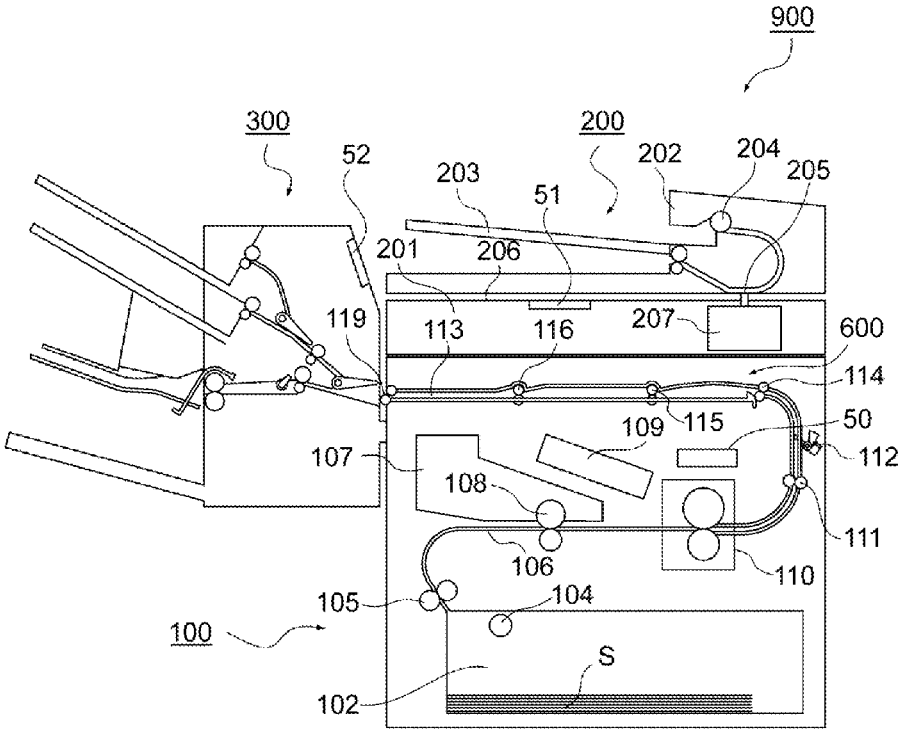
FIG. 1 is a cross-sectional view illustrating a configuration of an image forming apparatus according to a first embodiment of the invention.

Hereinafter, a mode for carrying out the invention will be exemplarily described in detail based on the embodiments by referring to the drawings. Here, since the dimension, the material, the shape, the relative position, and the like of the constituent described in the embodiments are appropriately modified by the configuration or various conditions of the apparatus according to the invention, the scope of the invention is not limited thereto as long as there is no particular description.

[First Embodiment]

FIG. 1 is a cross-sectional view illustrating a configuration of an image forming apparatus 900 according to a first embodiment of the invention. The image forming apparatus 900 is an image forming apparatus which uses an electrophotographic image forming process. As illustrated in FIG. 1, the image forming apparatus 900 includes an image forming apparatus body (hereinafter, simply referred to as an "apparatus body") 100, an image reading unit 200 which is disposed above the apparatus body 100, and a sheet post-processing device 300 which serves as a "sheet post-processing unit" connected to the side surface of the apparatus body 100. The apparatus body 100 includes therein an image forming process unit 107 which serves as an "image forming unit" for forming an image. The image forming unit includes a photosensitive drum 108 which serves as an "image bearing member", a transfer roller which serves as a "transfer device", and the like.

The image reading unit 200 reads out information described on an original. The sheet post-processing device 300 receives a sheet S discharged from the apparatus body 100 and selectively performs a predetermined process such as stapling on the sheet S.

An outline of the apparatus body 100 will be described. The apparatus body 100 conveys a plurality of sheets S stacked on a sheet cassette 102 while being separated one by one by a feeding roller 104 and a separation conveying roller 105 and conveys the sheet to the image forming process unit 107 along a conveying guide 106.

The image forming process unit 107 is an image forming unit which forms an image (a toner image) by an electrophotographic system. Specifically, a laser scanner 109 forms an image by irradiating light to the charged photosensitive drum 108, develops the image by using a toner, and transfers the toner image onto the sheet. The sheet onto which the toner image is transferred from the photosensitive drum 108 is conveyed to a fixing unit 110, and heat and pressure are applied thereto so as to fix the image.

A pair of post-fixing conveying rollers 111, a discharge sensor 112, a sheet conveying path 113, a pair of first conveying rollers 114, a pair of second conveying rollers 115, a pair of third conveying rollers 116, and a pair of discharge rollers 119 are provided. The pair of second conveying rollers 115 as a "pair of rollers" includes an upper roller 115*a* and a lower roller 115*b*, and the upper roller 115*a* and the lower roller 115*b* are configured to be driven independently (see FIG. 4). Further, the pair of first conveying rollers 114 as the "conveying unit" is a pair of rollers which is disposed at the upstream of the pair of second conveying rollers 115 in the conveying direction L and conveys the sheet to the pair of second conveying rollers 115. As an example of a configuration in which the upper and lower rollers 115*a* and 115*b* are driven independently, an electromagnetic clutch is used herein.

Further, the friction coefficient between the sheet S and the upper and lower rollers 115*a* and 115*b* is set to be larger than the friction coefficient between the sheets. For this reason, in a case where only the upper roller 115*a* is driven while two sheets S are nipped between the upper and lower rollers 115*a* and 115*b*, only one upper sheet S contacting the upper roller 115*a* is conveyed since the friction coefficient between the upper roller 115*a* and the sheet S is larger than the friction coefficient between the sheets S.

The sheet S having an image fixed thereto is conveyed to the pair of post-fixing conveying rollers 111. The conveyed sheet S passes the discharge sensor 112, and is conveyed to the sheet conveying path 113. In a case where the sheets S are directly discharged without being overlapped on each other, the sheets S are sequentially conveyed by the pair of first conveying rollers 114, the pair of second conveying rollers 115, and the pair of third conveying rollers 116. Then, the sheet S is discharged to the outside of the apparatus body 100 by the pair of discharge rollers 119, and the sheet S is delivered to the sheet post-processing device 300. A specific mechanism for overlapping the sheets S on each other will be described later.

The image reading unit 200 includes a scanner unit 201 and an automatic original feeding unit (hereinafter, referred to as an ADF) 202. The ADF 202 feeds a plurality of originals stacked on an original stack tray 203 while being separated one by one by a feeding roller 204 so that the original passes an original reading position 205 where an optical carriage 207 of the scanner unit 201 stops. Further, the ADF 202 may be opened or closed backward about a hinge (not illustrated) in rear of the apparatus, and is opened or closed when placing the original on an original base plate glass 206.

The controller 50 as the "control unit" controls the driving of the units or various members inside the apparatus body 100. Further, a controller 51 as a "control unit" controls the driving of the rollers or various members inside the image reading unit 200. In addition, a controller 52 as a "control unit" controls the driving of the rollers or various members inside the sheet post-processing device 300. The controller 50 transmits and receives various signals to and from the controller 51 and the controller 52, so that the controllers are interlocked with each other. Furthermore, the controller 50 may directly control the driving of the apparatus body 100, the image reading unit 200, and the sheet post-processing device 300 without the controller 51 or the controller 52.

Further, a driving mechanism U (see FIG. 3) as a driving unit to be described later is configured to independently drive the upper roller 115*a* and the lower roller 115*b* (see FIG. 4). The controller 51 is configured to control the driving mechanism. Then, although it will be described later, the driving timing is controlled so that a subsequent sheet S2 is conveyed to the downstream in the conveying direction L while being overlapped on a precedent sheet S1.

The apparatus body 100 includes therein a discharge sensor 112 as a "detecting unit" which is disposed at the upstream of the pair of second conveying rollers 115 in the conveying direction L (hereinafter, simply referred to as a "conveying direction L") and detects the position of the sheet. The controller 51 independently controls the driving timing of the pair of second conveying rollers 115 based on the detection result of the discharge sensor 112.

The scanner unit 201 includes a movable optical carriage 207, and reads out information described on the original. The scanner unit 201 reads out the information described on the original while the optical carriage 207 scans the original placed on the original base plate glass 206 in a horizontal direction, and photo-electrically converts the information by the CCD. Further, when reading out the original by the ADF 202, the optical carriage 207 stops at the original reading position 205 as described above and reads out the information described on the original which is being conveyed.

Figure 2:
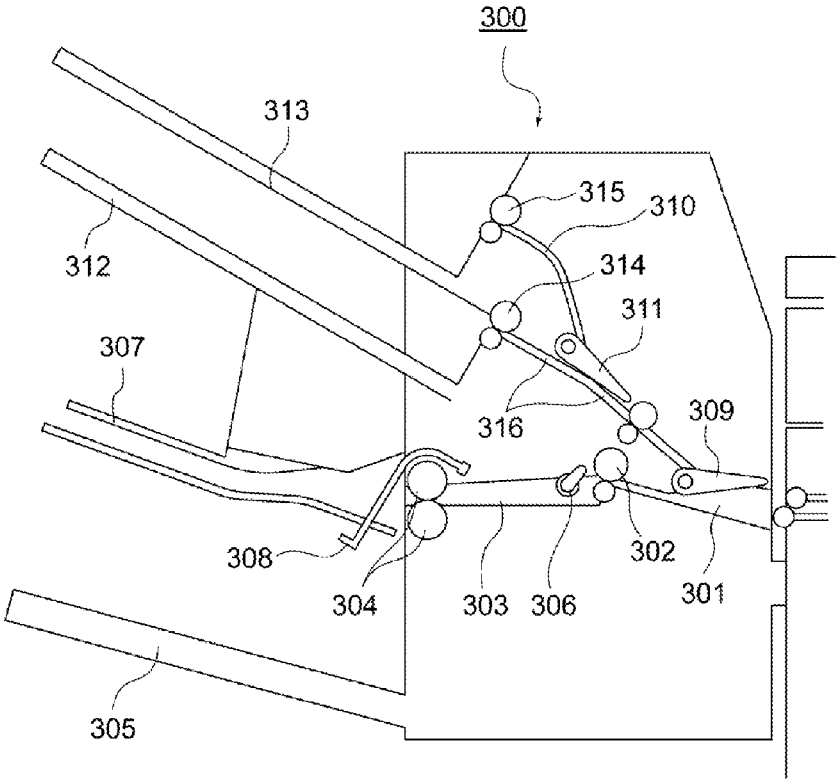
FIG. 2 is an enlarged cross-sectional view illustrating a configuration of a sheet post-processing device.

FIG. 2 is an enlarged cross-sectional view illustrating a configuration of the sheet post-processing device 300. Referring to FIG. 2, the sheet post-processing device 300 will be described. In FIG. 2, a part of the constituents are not illustrated in order to easily understand the configuration. The sheet post-processing device 300 includes a first conveying path 301, a pair of first conveying rollers 302, an intermediate stacking portion 303, a pair of first discharge rollers 304, and a first stack tray 305.

Further, the sheet post-processing device 300 includes a "conveying direction aligning unit" 306 which aligns the sheets S in the sheet conveying direction (hereinafter, simply referred to as a "conveying direction L"). Further, the sheet post-processing device 300 includes a "width direction aligning unit" 307 which aligns the sheets S in the sheet width direction (hereinafter, simply referred to as a "width direction M"). The sheet post-processing device 300 includes a full load detection flag 308. The sheet post-processing device 300 includes a stapler which is provided at one end of the intermediate stacking portion 303.

When discharging the sheet S to the first stack tray 305, the leading end of the first switching member 309 is held at the upper side in the drawing. The sheet S which is conveyed by the pair of discharge rollers 119 of the apparatus body 100 passes the first conveying path 301, and is discharged to the first stack tray 305 by the pair of first discharge rollers 304.

Further, when post-processing the sheets S, the pair of first discharge rollers 304 separates from each other, the sheets S are aligned by the conveying direction aligning portion 306 and the width direction aligning portion 307 while the lower surface of the sheet S is held by the intermediate stacking portion 303 and the width direction aligning portion 307. After post-processing a sheet bundle by a stapler after a predetermined number of sheets are aligned, the sheet bundle is discharged to the first stack tray 305 by being nipped by the pair of first discharge rollers 304.

In addition, the sheet post-processing device 300 includes a second conveying path 316, a third conveying path 310, a second switching member 311, a second stack tray 312, a third stack tray 313, a pair of second discharge rollers 314, and a pair of third discharge rollers 315.

When discharging the sheet S to the second stack tray 312, the leading end of the first switching member 309 is positioned at the lower side in the drawing and the leading end of the second switching member 311 is positioned at the upper side in the drawing. The sheet S passes the second conveying path 316, and is discharged onto the second stack tray 312 by the pair of second discharge rollers 314.

When discharging the sheet S to the third stack tray 313, the leading end of the first switching member 309 is held at the lower side in the drawing and the leading end of the second switching member 311 is held at the lower side in the drawing. The sheet S passes the third conveying path 310, and is discharged onto the third stack tray 313 by the pair of third discharge rollers 315.

Figure 3:
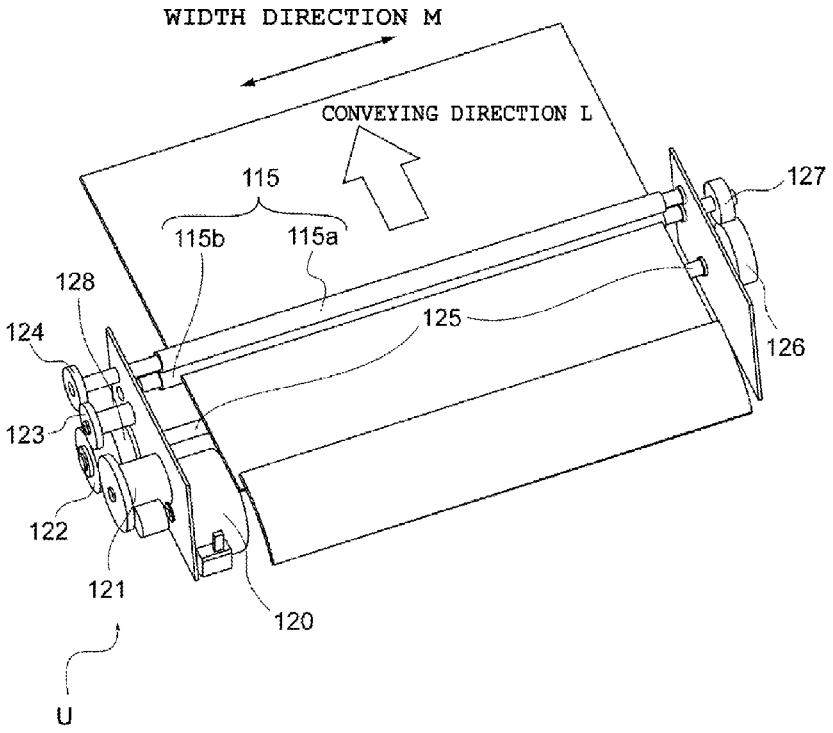
FIG. 3 is a perspective view illustrating a configuration of a driving system of a pair of second conveying rollers.

FIG. 3 is a perspective view illustrating a configuration of the driving mechanism U (the driving unit) of the pair of second conveying rollers 115. Referring to FIG. 3, a mechanism for independently driving the upper roller 115*a* and the lower roller 115*b* of the pair of second conveying rollers 115 will be described. A motor 120, a first idler gear 121, an electromagnetic clutch gear 122, a second idler gear 123, an upper roller gear 124, a driving transmission shaft 125, a driving transmission gear 126, a lower roller gear 127, and an electromagnetic clutch 128 are provided.

When driving only the upper roller 115*a*, the current to the electromagnetic clutch 128 is turned to off. With this configuration, the driving force of the motor 120 is transmitted to the electromagnetic clutch gear 122 through the first idler gear 121, but since the electromagnetic clutch 128 is turned off, the driving force is not transmitted to the driving transmission shaft 125, thus the driving transmission shaft 125 does not rotate. For this reason, the driving force is not transmitted to the lower roller gear 127, and the driving force is transmitted to only the second idler gear 123 and the upper roller gear 124, so that only the upper roller 115*a* rotates. In this way, by turning off the current to the electromagnetic clutch 128, only the upper roller 115*a* may be driven.

When driving the upper roller 115*a* and the lower roller 115*b*, the current to the electromagnetic clutch 128 is turned on. With this configuration, the driving force of the motor 120 is also transmitted to the driving transmission shaft 125, so that the lower roller 115*b* rotates through the driving transmission gear 126 and the lower roller gear 127. At this time, since the driving force of the motor 120 is also transmitted to the upper roller 115*a* through the first idler gear 121, the electromagnetic clutch gear 122, the second idler gear 123, and the upper roller gear 124, the upper roller 115*a* also rotates simultaneously with the lower roller 115*b*. In this way, by turning on the current to the electromagnetic clutch 128, it is possible to drive both the upper roller 115*a* and the lower roller 115*b*.

FIG. 4 is a cross-sectional view illustrating a configuration of an upper portion (a sheet conveying apparatus 600) of the apparatus body 100. Referring to FIG. 4, a mechanism for overlapping the sheets S on each other inside the apparatus body 100 will be described in detail. The operation diagrams in which the precedent sheet S1 and the subsequent sheet S2 coming out of the pair of post-fixing conveying rollers 111 are overlapped on each other are arranged in time series. Furthermore, here, in any one of the precedent sheet S1 and the subsequent sheet S2, the leading end of the sheet indicates the downstream end in the conveying direction L, and the tail end of the sheet indicates the upstream end in the conveying direction L. Further, the expression of the "driving of the pair of rollers" indicates the case where two rollers constituting the pair of rollers are both driven, and the expression of the "driving of a roller of the pair of rollers" indicates the case where one of the two rollers constituting the pair of rollers is driven.

Figure 4A:
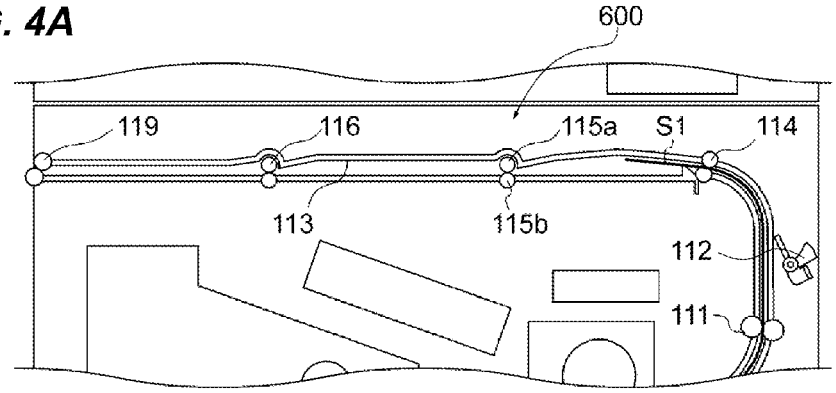
FIG. 4 is a cross-sectional view illustrating a configuration of an upper portion of an apparatus body.

As illustrated in FIG. 4A, the precedent sheet S1 which comes out of the fixing unit 110 is conveyed to the sheet conveying path 113 by the pair of post-fixing conveying rollers 111 and the pair of first conveying rollers 114. The position of the precedent sheet S1 is calculated by the controller 51 based on the information detected by the discharge sensor 112. The controller 51 controls the driving of the pair of second conveying rollers 115 based on the calculation. The upper and lower rollers 115*a* and 115*b* of the pair of second conveying rollers 115 are driven before the leading end of the precedent sheet S1 reaches the pair of second conveying rollers 115.

Figure 4B:
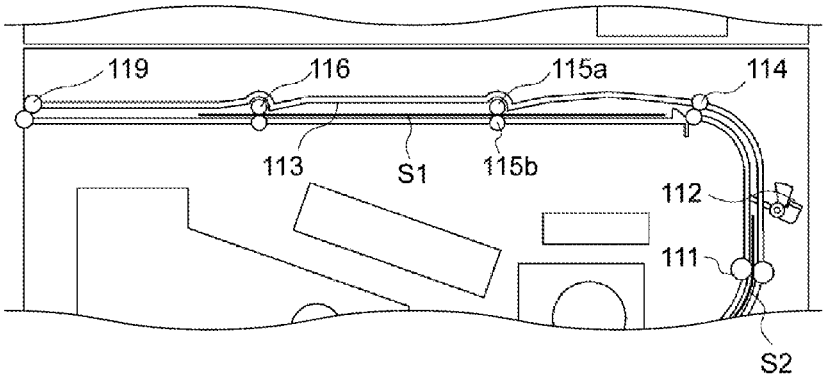

Subsequently, as illustrated in FIG. 4B, the precedent sheet S1 is conveyed by the upper and lower rollers 115*a* and 115*b* of the pair of second conveying rollers 115 even after the tail end of the precedent sheet S1 comes out of the pair of first conveying rollers 114. Then, the controller 51 stops the driving of the upper and lower rollers 115*a* and 115*b* of the pair of second conveying rollers 115 before the tail end of the precedent sheet S1 comes out of the pair of second conveying rollers 115. Then, the precedent sheet S1 temporarily stops at a position indicated in FIG. 4B in accordance with the stop of the driving. The stop position of the precedent sheet S1 is controlled based on the information detected by the discharge sensor 112.

Here, the pair of third conveying rollers 116 is a pair of rollers which is provided for a case where a small-size sheet is conveyed, where the pair of rollers forms a nip therebetween when conveying a small-size sheet, but the pair of rollers are kept separated from each other when conveying a large-size sheet. In the embodiment, the pair or rollers separates from each other in an entire time since the large-size sheet is conveyed.

Figure 4C:
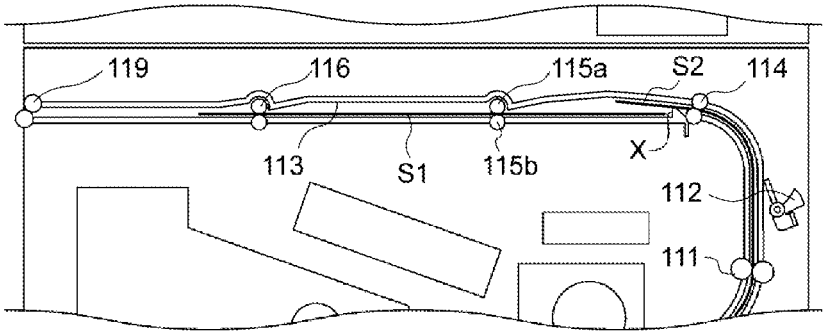

Subsequently, as illustrated in FIG. 4C, the subsequent sheet S2 comes out of the fixing unit 110, and is conveyed to the sheet conveying path 113 by the pair of post-fixing conveying rollers 111 and the pair of first conveying rollers 114. An appropriate step X is formed in the sheet conveying path 113 so as to prevent a case where the conveyed subsequent sheet S2 goes under the temporarily stopped precedent sheet S1 or collides with the tail end of the precedent sheet S1 to thereby cause a jam. By using the step X, the submarine movement or the jam of the subsequent sheet S2 is prevented, and hence the subsequent sheet S2 may be reliably overlapped on the precedent sheet S1.

Figure 5A:
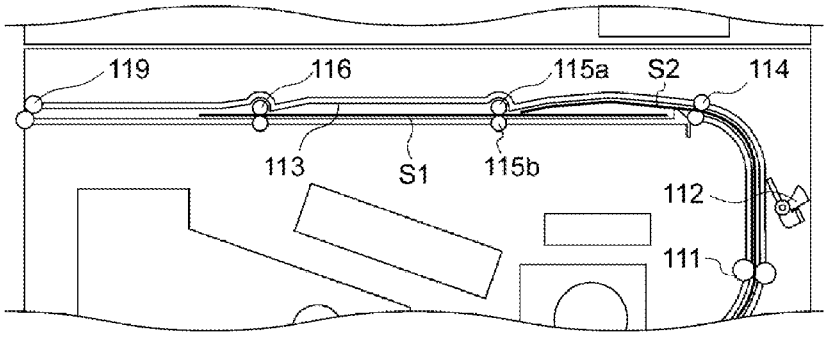
FIG. 5 is a cross-sectional view illustrating a configuration of the upper portion of the apparatus body.

Subsequently, as illustrated in FIG. 5A, the subsequent sheet S2 is continuously conveyed by the pair of post-fixing conveying rollers 111 and the pair of first conveying rollers 114. Then, the controller 51 performs a control so that the stopped upper and lower rollers 115*a* and 115*b* of the pair of second conveying rollers 115 are driven again before the leading end of the subsequent sheet S2 reaches the pair of second conveying rollers 115. The case before the leading end of the subsequent sheet S2 reaches the pair of second conveying rollers 115 indicates the case where the position of the subsequent sheet S2 becomes the position of the sheet S illustrated in FIG. 5A. Furthermore, the position of the subsequent sheet S2 is also calculated based on the information detected by the discharge sensor 112 as in the position of the precedent sheet S1.

Figure 5B:
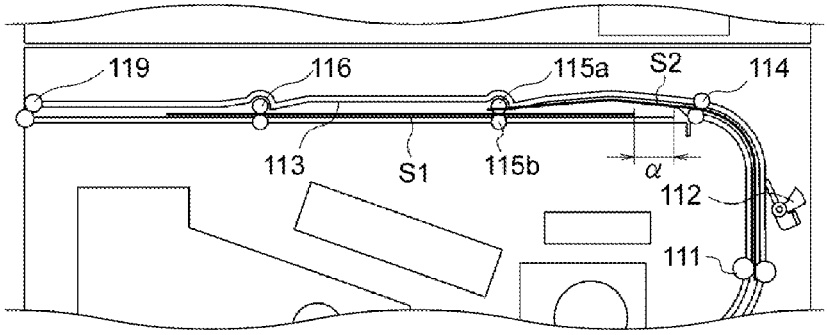

Subsequently, as illustrated in FIG. 5B, the temporarily stopped precedent sheet S1 is conveyed again in the conveying direction L by the driving of the upper and lower rollers 115*a* and 115*b* of the pair of second conveying rollers 115. The subsequent sheet S2 is also conveyed along with the precedent sheet S1, and the leading end of the subsequent sheet S2 is nipped between the upper and lower rollers 115*a* and 115*b* of the pair of second conveying rollers 115. After the nipping, the control is switched so that the driving of the lower roller 115*b* is stopped and only the upper roller 115*a* is driven. By this control, the precedent sheet S1 temporarily stops at a position in which the sheet advances from the initially stopped position by a predetermined amount $\alpha$.

Figure 5C:
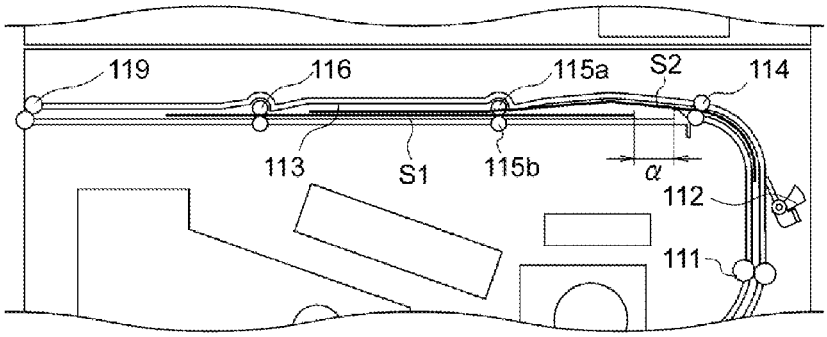

Subsequently, as illustrated in FIG. 5C, the controller 51 drives the upper roller 115*a* while stopping the driving of the lower roller 115*b* among the pair of second conveying rollers 115 after the leading end of the subsequent sheet S2 is nipped by the pair of second conveying rollers 115. For this reason, the precedent sheet S1 keeps on stopping at a position in which the sheet advances by a predetermined amount α, and only the subsequent sheet S2 is continuously conveyed in the conveying direction L.

Figure 6A:
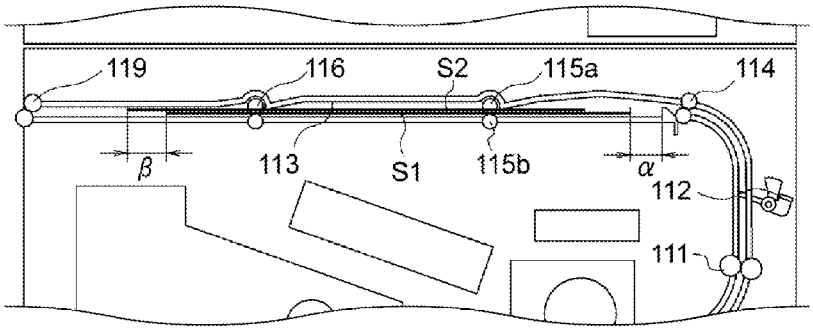
FIG. 6 is a cross-sectional view illustrating a configuration of the upper portion of the apparatus body.

Subsequently, as illustrated in FIG. 6A, the subsequent sheet S2 is conveyed by the driving of the upper roller 115*a* until the subsequent sheet S2 advances by a predetermined amount (a shift amount β) toward the downstream in the conveying direction L in relation to the precedent sheet S1.

Figure 6B:
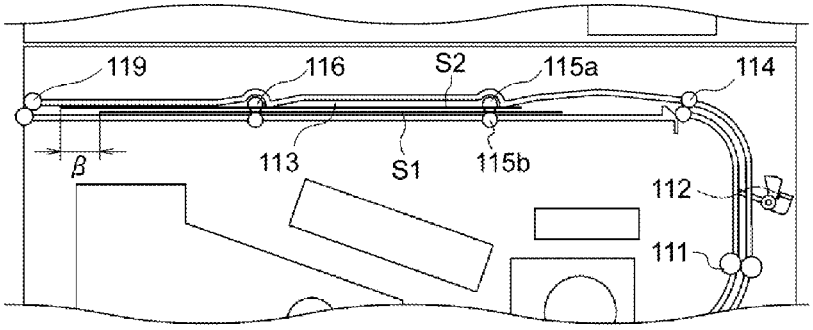

Subsequently, as illustrated in FIG. 6B, both the upper and lower rollers 115*a* and 115*b* of the pair of second conveying rollers 115 are driven by resuming the driving of the lower roller 115*b*. Accordingly, two sheets are conveyed together while the precedent sheet S1 and the subsequent sheet S2 ensure the shift amount β therebetween. Subsequently, the sheets are discharged from the apparatus body 100 by the pair of discharge rollers 119 and are delivered to the sheet post-processing device 300.

The controller 51 conveys the sheets in a overlapped state while the subsequent sheet S2 advances by the predetermined amount (the shift amount β) in the conveying direction L in relation to the precedent sheet S1 when driving the pair of second conveying rollers 115 after the subsequent sheet S2 is conveyed by a predetermined amount through the driving of only the upper roller 115*a*. The positions of the sheets S1 and S2 are controlled based on the information detected by the discharge sensor 112 positioned at the upstream of the upper and lower rollers 115*a* and 115*b* which are independently driven at the upper and lower positions, and the shift amount β is formed by stopping the precedent sheet S1 once. For this reason, it is possible to improve the precision of the shift amount β. Further, the driving control for both the upper and lower rollers 115*a* and 115*b* of the pair of second conveying rollers 115 is effective for controlling the shift amount β with high precision.

Figure 7A:
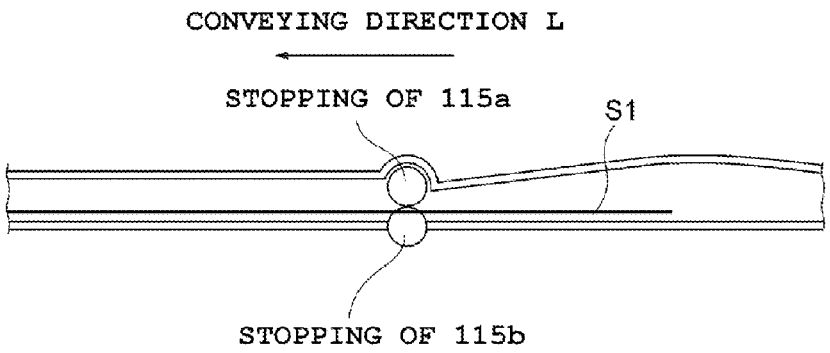
FIG. 7 is a conceptual diagram illustrating a relation between forces applied to a sheet.
Figure 7B:
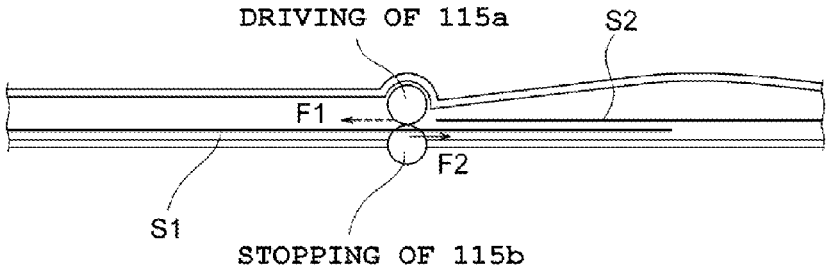

FIG. 7 is a conceptual diagram illustrating a relation between forces applied to the sheet. If only the upper roller 115*a* is driven when the subsequent sheet S2 enters the nip of the pair of second conveying rollers 115 as in FIG. 7B, a force F1 for conveying the precedent sheet S1 in the conveying direction L is exerted on the upper surface of the stopped precedent sheet S1 by the upper roller 115*a*. Then, a friction force F2 which is exerted with respect to the lower roller 115*b* in a direction opposite to that of the force F1 is generated at the lower surface of the stopped precedent sheet S1.

When the force F1 for conveying the precedent sheet S1 by the driving of the upper roller 115*a* is larger than the friction force F2, the precedent sheet S1 moves in the conveying direction L and the movement of the precedent sheet S1 becomes unstable. Therefore, it is difficult to control the shift amount with high precision. Accordingly, when the subsequent sheet S2 enters the nip of the pair of second conveying rollers 115, the precedent sheet S1 is also conveyed by a predetermined amount along with the subsequent sheet S2 by driving both the upper and lower rollers 115*a* and 115*b*. Accordingly, it is possible to control the shift amount β with high precision. Subsequently, two sheets S which are overlapped on each other while the subsequent sheet S2 advances by the shift amount β in the conveying direction L in relation to the precedent sheet S1 are aligned inside the sheet post-processing device 300.

Figure 10A:
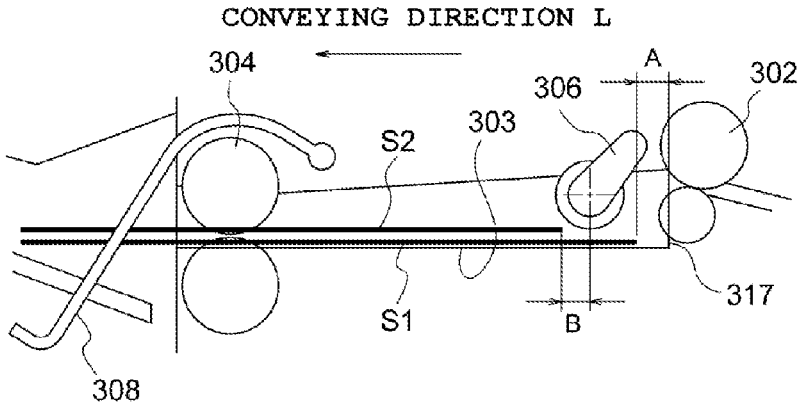
FIG. 10 is a cross-sectional view illustrating a configuration of an aligning portion in the conveying direction of a sheet post-processing device.
Figure 10B:
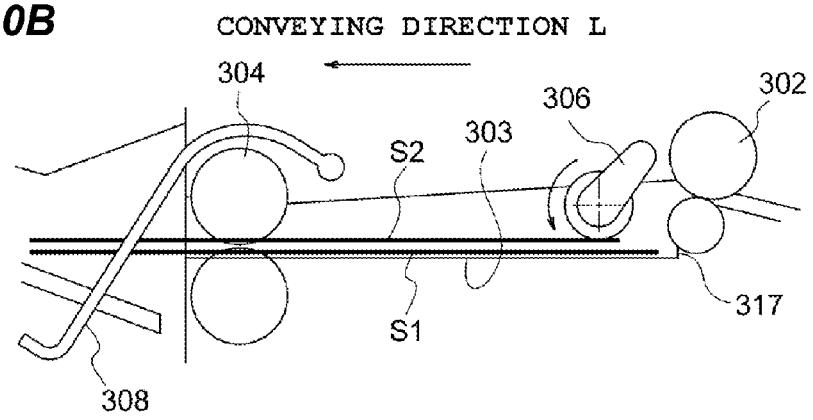
Figure 10C:
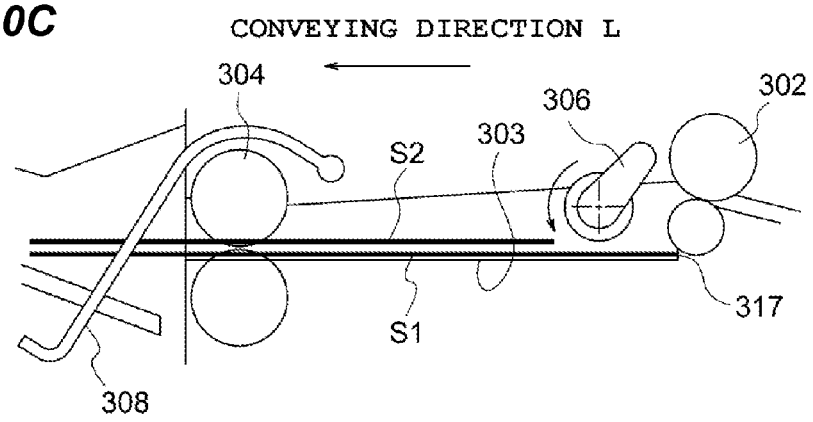

Here, referring to FIG. 10, the inside of the apparatus body 100 will be described further. Inside the apparatus body 100, the intermediate stacking portion 303, the aligning reference wall 317, and the conveying direction aligning portion 306 are arranged. Furthermore, the pair of second conveying rollers 115 is disposed at the upstream of the sheet post-processing device 300 in the conveying direction L. The intermediate stacking portion 303 as the "stacking portion" is a plate-like portion (a frame) which temporarily stacks the sheets thereon so as to align the sheets. The aligning reference wall 317 is a wall which is provided in a direction substantially perpendicular to the intermediate stacking portion 303 so as to be used as a reference for aligning the sheets in the conveying direction L. The conveying direction aligning portion 306 as the "aligning unit" is a member which is disposed at the downstream of the aligning reference wall 317 in the conveying direction L, moves downward from the upper side so as to abut the sheets, and rotates and conveys the sheets to the aligning reference wall 317 so as to align the sheets.

Here, a case is assumed in which the distance between the tail end of the precedent sheet S1 and the aligning reference wall 317 is denoted by A and the distance between the tail end of the subsequent sheet S2 and the conveying direction aligning portion 306 is denoted by B. In this case, the position of the conveying direction aligning portion 306 needs to satisfy a relation of A=B as much as possible so as to prevent an aligning failure as described above before starting the aligning operation (see FIG. 10A). For this reason, the aligning failure is controlled by setting the position of the conveying direction aligning portion 306 and the shift amount β so as to satisfy the relation of A=B.

Regarding two sheets S1 and S2 which are conveyed by the intermediate stacking portion 303, the tail ends of the sheets S collide with the aligning reference wall 317 by the conveying direction aligning portion 306, so that the sheets S1 and S2 are first aligned in the conveying direction L. Subsequently, the side ends of the sheets are pressed by the width direction aligning portion 307 (see FIG. 2), so that the sheets are aligned in the width direction M. The aligning operation of the conveying direction L and the aligning operation of the width direction M are repeated as many as the number of sheets of the subsequent jobs, and after a predetermined number of sheets are aligned, the sheet bundle undergoes the post-processing by the stapler. The sheet bundle having been subjected to the post-processing is nipped by the pair of first discharge rollers 304. Then, the sheet bundle is conveyed by the pair of first discharge rollers 304 and is discharged to the first stack tray 305 (see FIG. 2).

Here, returning to FIG. 7, the reason why the subsequent sheet S2 is not conveyed by the driving of only the upper roller 115*a*, but the subsequent sheet S2 is conveyed by the driving of both the upper roller 115*a* and the lower roller 115*b* when the position of the subsequent sheet S2 becomes the position of the sheet S illustrated in FIG. 5A will be described.

As illustrated in FIG. 7A, the precedent sheet S1 which is conveyed in the direction indicated by the arrow is nipped by the upper roller 115*a* and the lower roller 115*b* which are independently driven at the upper and lower positions, and the driving of the upper roller 115*a* and the lower roller 115*b* stops before the tail end of the precedent sheet S1 comes out of the nip of the pair of rollers. Accordingly, the precedent sheet S1 stops at a predetermined position.

Subsequently, as illustrated in FIG. 7B, the subsequent sheet S2 is conveyed, and the driving of only the upper roller 115*a* is resumed so as to convey only the subsequent sheet S2 immediately before the subsequent sheet S2 is nipped by the upper roller 115*a* and the lower roller 115*b* which are independently driven at the upper and lower positions. Then, only the subsequent sheet S2 is conveyed by driving only the upper roller 115*a* until the subsequent sheet S2 advances by the shift amount β in the conveying direction L in relation to the precedent sheet S1.

Figure 7C:
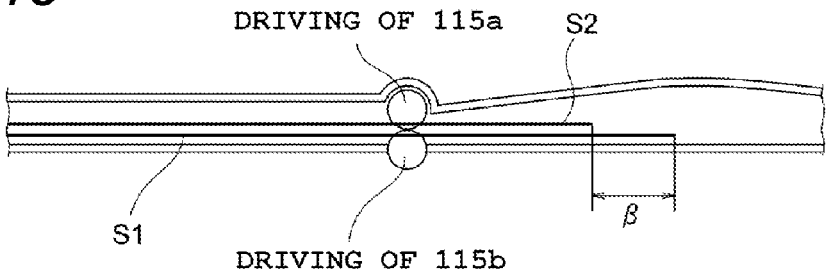

Subsequently, as illustrated in FIG. 7C, the driving of the lower roller 115*b* is resumed at a time point at which the shift amount β is formed, so that the driving of both rollers is resumed. Accordingly, a configuration is adopted in which two sheets are conveyed together while the shift amount β is formed between the precedent sheet S1 and the subsequent sheet S2.

However, in FIG. 7B, the force F1 for conveying the precedent sheet S1 in the conveying direction L by the upper roller 115*a* is exerted on the upper surface of the stopped precedent sheet S1 when the subsequent sheet S2 enters the nip of the rollers. Accordingly, the friction force F2 which is exerted with respect to the lower roller 115*b* in a direction opposite to that of the force F1 is generated at the lower surface of the stopped precedent sheet S1. For this reason, when the force F1 for conveying the precedent sheet S1 by the driving of the upper roller 115*a* is larger than the friction force F2, the precedent sheet S1 moves in the conveying direction L, so that the movement of the precedent sheet S1 becomes unstable. For this reason, it is difficult to control the shift amount β with high precision.

With the above-described reason, in the embodiment, when the position of the subsequent sheet S2 becomes the position of the sheet S illustrated in FIG. 5B, the subsequent sheet S2 is not conveyed by the driving of only the upper roller 115*a*, but the subsequent sheet S2 is conveyed by the driving of both the upper roller 115*a* and the lower roller 115*b*.

Furthermore, in the embodiment, since the pair of second conveying rollers 115 having the upper and lower rollers 115*a* and 115*b* which are independently driven is provided inside the sheet conveying path 113, it is possible to buffer the precedent sheet S1. When it is possible to buffer the first page of the subsequent jobs upon subjecting the discharged sheets S to post-processing such as stapling, it is possible to solve a problem in which the productivity is degraded compared to the case where the sheets are simply discharged.

[Second Embodiment]

FIG. 8 is a cross-sectional view illustrating a configuration of a sheet conveying apparatus 700 according to a second embodiment, and referring to FIG. 8, a mechanism for overlapping the sheets S on each other inside an apparatus body 800 as an "image forming apparatus body" will be described. Here, the operation diagrams of conveying the precedent sheet S1 and the subsequent sheet S2 coming out of the pair of post-fixing conveying rollers 111 in a overlapped state are arranged in time series. FIG. 9 is a cross-sectional view illustrating a configuration of a sheet post-processing mechanism 400 as a "sheet post-processing unit", and referring to FIG. 9, a mechanism for aligning the sheets S inside the apparatus body 800 will be described. Even here, the operations of aligning the precedent sheet S1 and the subsequent sheet S2 are arranged in time series. Regarding the same configurations as those of the first embodiment, the description thereof will not be repeated by giving the same reference numerals thereto. Further, since the sheet conveying apparatus 700 is assembled in the image forming apparatus 900 of the first embodiment, the description of the image forming apparatus will not be also repeated herein.

The second embodiment is particularly different from the first embodiment in the following points. The controller 50 conveys the precedent sheet S1 so that the precedent sheet advances by a predetermined amount (a shift amount γ) to the downstream in the conveying direction L in relation to the subsequent sheet S2 upon driving the pair of second conveying rollers 115 after the subsequent sheet S2 is conveyed by a predetermined amount by the driving of the upper roller 115*a*. Furthermore, the driving control of the upper and lower rollers 115*a* and 115*b* of the pair of second conveying rollers 115 is performed as in the control of the first embodiment up to the description of FIG. 5C of the first embodiment.

Figure 8A:
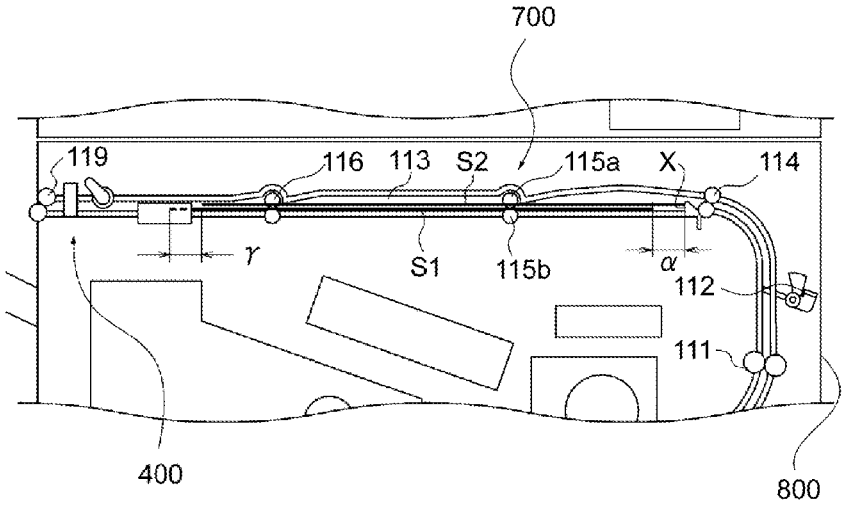
FIG. 8 is a cross-sectional view illustrating a configuration of a sheet conveying apparatus according to a second embodiment.

As illustrated in FIG. 8A, since the driving of the lower roller 115*b* stops and only the upper roller 115*a* is driven, the precedent sheet S1 keeps on stopping at a position where the precedent sheet advances by a predetermined amount α, and only the subsequent sheet S2 is conveyed in the conveying direction L. Then, only the subsequent sheet S2 is conveyed by driving only the upper roller 115*a* until the precedent sheet S1 advances by the shift amount γ in the conveying direction L in relation to the subsequent sheet S2. Then, the driving of the lower roller 115*b* is resumed at a time point in which the shift amount γ is formed.

Figure 8B:
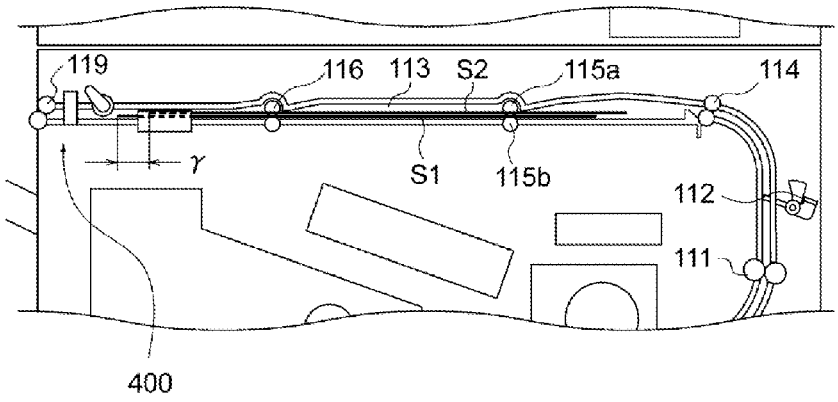

Subsequently, as illustrated in FIG. 8B, since the driving of the lower roller 115*b* is resumed, the precedent sheet S1 and the subsequent sheet S2 are conveyed by the driving of both the upper and lower rollers 115*a* and 115*b* of the pair of second conveying rollers 115 while the shift amount γ is formed between two sheets. Subsequently, the sheets are discharged from the apparatus body 100 by the pair of discharge rollers 119, and are delivered to the sheet post-processing device 300.

Subsequently, two sheets S which are overlapped on each other while the precedent sheet S1 advances by the shift amount γ in the conveying direction L in relation to the subsequent sheet S2 are aligned by a sheet post-processing mechanism 400 which is provided as a downstream reference inside the apparatus body 100.

Figure 9A:
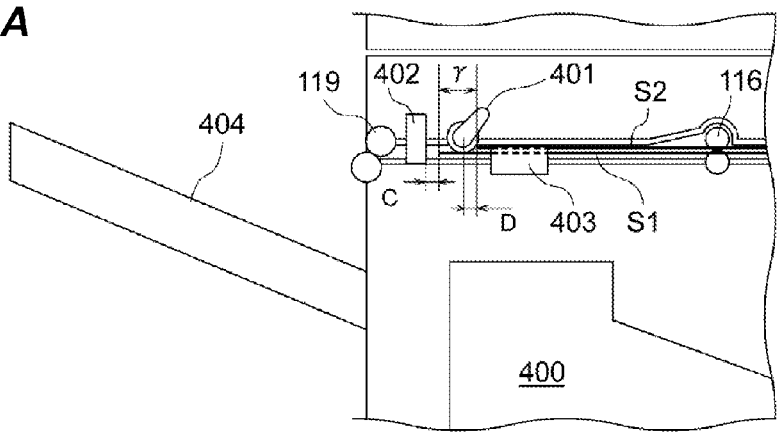
FIG. 9 is a cross-sectional view illustrating a configuration of an upper portion of an apparatus body.
Figure 9B:
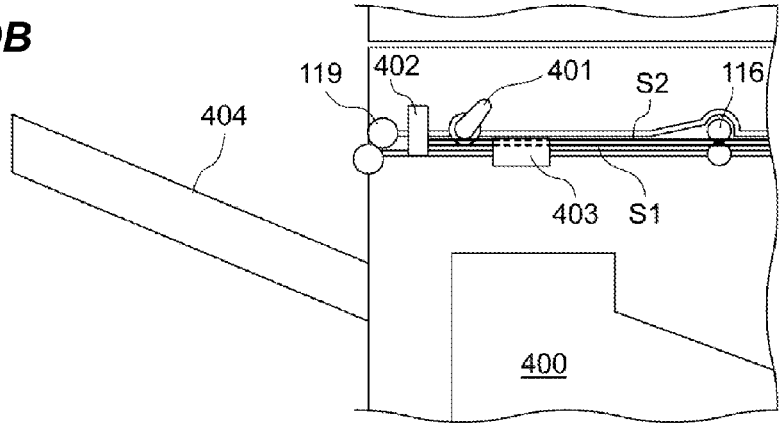

FIG. 9 is a cross-sectional view illustrating a configuration of an upper portion of the apparatus body 800. As illustrated in FIG. 9A, the sheet post-processing mechanism 400 includes an aligning reference wall 402 which serves as a "reference wall" and a conveying direction aligning portion 401 which serves as an "aligning unit". Here, a case is assumed in which the distance between the leading end of the precedent sheet S1 and the aligning reference wall 402 in the conveying direction L is denoted by C and the distance between the leading end of the subsequent sheet S2 and the conveying direction aligning portion 401 is denoted by D. In this case, it is desirable to set the position of the conveying direction aligning portion 401 that performs the aligning operation in the conveying direction L so as to satisfy the relation of C=D with high precision as much as possible so that an aligning failure is suppressed before the aligning operation starts. For this reason, the control is performed so that the position of the conveying direction aligning portion 306 and the shift amount γ are set so as to satisfy the relation of C=D as much as possible.

Regarding two sheets S1 and S2 which are conveyed to the position of FIG. 9A, the leading ends of the sheets S collide with the aligning reference wall 402 by the conveying direction aligning portion 401 after the pair of second conveying rollers 115 separates from each other, so that the sheets S1 and S2 are first aligned in the conveying direction L (the left and right direction in the drawing). Subsequently, the side ends of the sheets are pressed by the width direction aligning portion 403 that performs an aligning operation in the width direction M, so that the sheets are aligned in the width direction M (the front and back direction in the drawing). The aligning operation is performed based on the tail ends of the sheets in the first embodiment, but the aligning operation is performed based on the leading ends of the sheets in the second embodiment. After a predetermined number of sheets are aligned by repeating the aligning operation of the conveying direction L and the aligning operation of the width direction M as many as the number of sheets of the subsequent jobs, the leading end of the sheet bundle is post-processed by a stapler (not illustrated). The state of the sheets S having been subjected to the post-processing becomes the state illustrated in FIG. 9B.

Figure 9C:
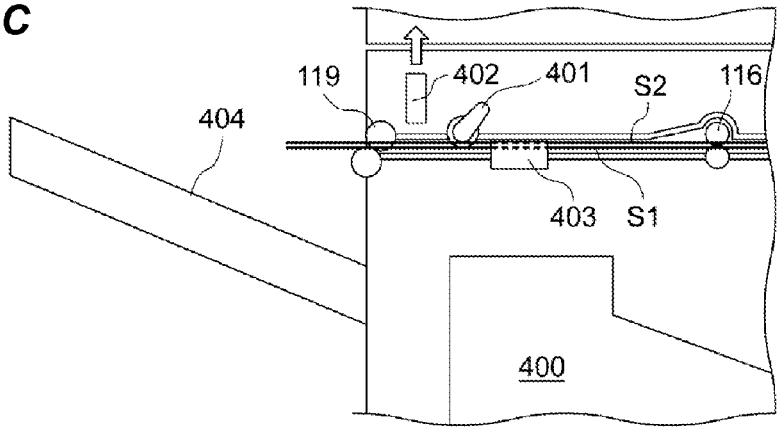

Subsequently, as illustrated in FIG. 9C, the sheet bundle having been subjected to the post-processing is discharged onto the stack tray 404 after the aligning reference wall 402 retracts upward as indicated by the arrow and the pair of second conveying rollers 115 nipping the sheet bundle and the pair of discharge rollers 119 are driven again.

As described above, in the embodiment, it is possible to overlap the subsequent sheet S2 on the precedent sheet S1 while the precedent sheet S1 advances by the shift amount γ in the conveying direction L. Even in the second embodiment, as in the first embodiment, the positions of the precedent sheet S1 and the subsequent sheet S2 are calculated based on the information detected by the discharge sensor 112 which is positioned at the upstream of the upper and lower rollers 115*a* and 115*b* independently driven at the upper and lower positions, and the shift amount γ is formed by stopping the precedent sheet S1 once. For this reason, the precision of the shift amount γ may be improved.

In this way, in the second embodiment, the same effect as that of the first embodiment may be obtained. Further, when aligning two sheets S in the conveying direction L, the sheets are aligned based on the tail ends thereof in the first embodiment, but the sheets may be aligned based on the leading ends thereof in the second embodiment. When the sheets may be aligned based on the leading ends thereof, the sheet post-processing device which is provided as the downstream reference as in the sheet post-processing mechanism 400 may be provided inside the apparatus body 100. Accordingly, a decrease in the size of the sheet post-processing device may be also realized compared to the first embodiment.

According to the configuration of the first or second embodiment, the precedent sheet S1 is stably conveyed by the control in which the pair of second conveying rollers 115 is driven again before the leading end of the subsequent sheet S2 reaches the pair of second conveying rollers 115. As a result, even when there is a variation in the shift amount γ between the precedent sheet S1 and the subsequent sheet S2 which are being conveyed, it is possible to control the shift amount γ of the sheets with high precision.

Furthermore, the friction force F2 is not applied to the precedent sheet S1 by the control in which the pair of second conveying rollers 115 is driven again before the leading end of the subsequent sheet S2 reaches the pair of second conveying rollers 115.

Further, according to the configuration of the first embodiment, when the subsequent sheet S2 is overlapped on the precedent sheet S1 while the shift amount is controlled with high precision, the relation of A=B is satisfied with high precision. Even in this configuration, when the sheet post-processing device 300 is disposed at the downstream side in the conveying direction L, the aligning failure generated when aligning two sheets of the precedent sheet S1 and the subsequent sheet S2 may be suppressed.

Furthermore, according to the configuration of the second embodiment, when the subsequent sheet S2 is overlapped on the precedent sheet S1 while the shift amount is controlled with high precision, the relation of C=D is satisfied with high precision. Even in this configuration, when the sheet post-processing mechanism 400 is disposed at the upstream side in the conveying direction L, the aligning failure generated when aligning two sheets of the precedent sheet S1 and the subsequent sheet S2 may be suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application is a National Stage Application of PCT/JP2012/007765, which was filed on Dec. 4, 2012, and which claims the benefit of Japanese Patent Application No. 2011-270098, filed Dec. 9, 2011, both of which are hereby incorporated by reference herein in their entireties.

The invention claimed is:

1. A sheet conveying apparatus comprising:

a pair of rollers which includes an upper roller and a lower roller and conveys a sheet in a sheet conveying direction and in a nipping manner;

a driving unit which independently drives the upper roller and the lower roller;

a conveying unit which is disposed upstream of the pair of rollers with respect to the sheet conveying direction and conveys the sheet to the pair of rollers;

an overlapping unit which is provided between the pair of rollers and the conveying unit and overlaps a subsequent sheet on a precedent sheet with respect to the sheet conveying direction;

a control unit which controls the driving unit; and a sheet post-processing unit that includes a stacking portion which temporarily stacks the sheets thereon so as to align the sheets, a reference wall which is provided in the stacking portion as a reference for aligning the sheets in the sheet conveying direction, and an aligning unit which is disposed downstream of the reference wall with respect to the sheet conveying direction, abuts the sheets from an upper side, and conveys the sheets to the reference wall so as to align the sheets, wherein the pair of rollers is disposed upstream of the sheet post-processing unit with respect to the sheet conveying direction, and wherein the control unit controls the driving unit so that:

the upper roller and the lower roller are driven before a leading end of the precedent sheet conveyed by the conveying unit reaches the pair of rollers, and the driving of the upper roller and the lower roller is stopped before a tail end of the precedent sheet passes the pair of rollers, the pair of rollers is driven again before a leading end of the subsequent sheet conveyed by the conveying unit and overlapped on the precedent sheet nipped by the pair of rollers reaches the pair of rollers, and only the upper roller is driven so as to convey the subsequent sheet downstream in the sheet conveying direction after the leading end of the subsequent sheet conveyed by the conveying unit reaches the pair of rollers, and form an overlapping state where the leading end of the subsequent sheet advances by a predetermined amount downstream in the sheet conveying direction from the leading end of the precedent sheet, and the upper roller and the lower roller are driven so as to convey the precedent sheet and the subsequent sheet overlapped on the precedent sheet downstream in the sheet conveying direction.

2. The sheet conveying apparatus according to claim 1, further comprising:

a detecting unit which is disposed upstream of the pair of rollers with respect to the sheet conveying direction and which detects the sheets, wherein the control unit controls the driving unit based on a detection result of the detecting unit.

3. The sheet conveying apparatus according to claim 1, wherein the overlapping unit includes a step which is formed in a conveying path between the conveying unit and the pair of rollers, and wherein the subsequent sheet conveyed by the conveying unit is overlapped on the precedent sheet on the step.

4. An image forming apparatus comprising:

an image forming unit which forms an image; and the sheet conveying apparatus according to claim 1.

5. A sheet conveying apparatus comprising:

a pair of rollers which includes an upper roller and a lower roller and conveys a sheet in a sheet conveying direction and in a nipping manner;

a driving unit which independently drives the upper roller and the lower roller;

a conveying unit which is disposed upstream of the pair of rollers with respect to the sheet conveying direction and conveys the sheet to the pair of rollers;

an overlapping unit which is provided between the pair of rollers and the conveying unit and overlaps a subsequent sheet on a precedent sheet with respect to the sheet conveying direction;

a control unit which controls the driving unit;

a sheet post-processing unit that includes a stacking portion which temporarily stacks the sheets thereon so as to align the sheets, a reference wall which is provided in the stacking portion as a reference for aligning the sheets with respect to the sheet conveying direction, and an aligning unit which is disposed downstream of the reference wall with respect to the sheet conveying direction, moves downward from an upper side so as to abut the sheets, and conveys the sheets to the reference wall so as to align the sheets, wherein the pair of rollers is disposed upstream of the sheet post-processing unit with respect to the sheet conveying direction, wherein the control unit controls the driving unit so that:

the upper roller and the lower roller are driven before a leading end of the precedent sheet conveyed by the conveying unit reaches the pair of rollers and the driving of the upper roller and the lower roller is stopped before a tail end of the precedent sheet passes the pair of rollers, the pair of rollers is driven again before a leading end of the subsequent sheet conveyed by the conveying unit and overlapped on the precedent sheet nipped by the pair of rollers reaches the pair of rollers, and only the upper roller is driven so as to convey the subsequent sheet downstream in the sheet conveying direction after the leading end of the subsequent sheet conveyed by the conveying unit reaches the pair of rollers, and form an overlapping state where the subsequent sheet advances by a predetermined amount downstream in the sheet conveying direction from the precedent sheet, and the upper roller and the lower roller are driven so as to convey the precedent sheet and the subsequent sheet overlapped on the precedent sheet downstream in the sheet conveying direction.

* * * * *